US006500049B2

(12) United States Patent
Orii et al.

(10) Patent No.: US 6,500,049 B2
(45) Date of Patent: Dec. 31, 2002

(54) LAPPING OIL COMPOSITION FOR FINISH-GRINDING

(75) Inventors: Kazuya Orii, Tokyo (JP); Isao Saito, Tokyo (JP); Yasutoshi Fujita, Tokyo (JP); Toshimichi Sakurada, Tokyo (JP); Masao Yamaguchi, Tokyo (JP)

(73) Assignees: Tokyo Magnetic Printing Co., Ltd., Tokyo (JP); TDK Corporation, Tokyo (JP)

( * ) Notice: Subject to any disclaimer, the term of this patent is extended or adjusted under 35 U.S.C. 154(b) by 111 days.

(21) Appl. No.: 09/747,684

(22) Filed: Dec. 26, 2000

(65) Prior Publication Data

US 2001/0009840 A1 Jul. 26, 2001

(30) Foreign Application Priority Data

Jan. 18, 2000 (JP) ..... 2000-008715

(51) Int. Cl.[7] ..... B24B 1/00

(52) U.S. Cl. ..... 451/36; 451/41; 51/307; 51/308; 51/309; 156/345.12; 438/692

(58) Field of Search ..... 451/36–37, 41, 451/59; 51/29, 307–309; 156/345, 12; 438/692–693

(56) References Cited

U.S. PATENT DOCUMENTS

| | | | | | |
|---|---|---|---|---|---|
| 4,385,138 | A | * | 5/1983 | Sagane et al. | 523/402 |
| 5,942,015 | A | * | 8/1999 | Culler et al. | 51/295 |
| 5,958,794 | A | * | 9/1999 | Bruxvoort et al. | 438/692 |
| 5,968,238 | A | * | 10/1999 | Healy et al. | 106/3 |
| 6,383,239 | B1 | * | 5/2002 | Susuki et al. | 51/307 |

* cited by examiner

*Primary Examiner*—Eileen P. Morgan
(74) *Attorney, Agent, or Firm*—Drinker Biddle & Reath LLP

(57) ABSTRACT

The present invention relates to a lapping oil composition which is advantageously used in finish-grinding of a material to provide a high-quality grinding surface, without selective grinding, which is generally caused during lapping and polishing processes of the composite material. The lapping oil composition contains at least one acetylene glycol compound and preferably further contains at least one at least one phosphoric ester compound.

11 Claims, 4 Drawing Sheets

Relationship between PTR and the amount of improver and surface quality improver

LAPPING OIL COMPOSITION FOR FINISH-GRINDING

FIELD OF THE INVENTION

The present invention relates to a lapping oil composition which is advantageously used in finish-grinding of a material to provide a high-quality grinding surface. The present invention particularly relates to a lapping oil composition which is advantageously used in finish-grinding in which a composite material composed of a plurality of materials having different hardness from each other is uniformly ground to provide a high-quality grinding surface, without causing difference in the grinding amount between soft materials and rigid materials, i.e. selective grinding, which is generally caused during lapping and polishing processes of the composite material. The present invention further relates to a lapping oil composition which is advantageously used in finish-grinding in which a composite material is uniformly ground to provide high-quality grinding surface, without causing difference in the grinding amount between different materials, i.e. selective grinding, said finish-grinding using a lap liquid containing no abrasive grains which is conducted after the grinding processing of a surface of a thin film magnetic head to be an air bearing surface, using free abrasive slurry.

PRIOR ART

Recently, higher performance and higher function have been more and more demanded for optical parts, electronic parts, precision machine parts or the like, and wide range of materials have been used for such parts, such as metallic crystalline materials, ceramics, glass, plastics and so forth.

As one of the manufacturing processes of such parts, grinding or polishing of a composite material composed of a plurality of materials having different hardness from each other is frequently introduced. Recited as examples of grinding processing of composite materials are: in the field of electronics, texturing of Ni—P plating of a hard disk substrate, uniform working of wiring metal layers and insulation films between the layers in multiple layer wiring process of LSI; and in the field of optics, grinding of the connector end faces of optical fibers consisting of a composite material composed of zirconia ceramics (so called "ferrule"), quartz glass (so called "core" of fiber) and fluoroplastics (so called "clad").

With respect to a hard disk drive (i.e. a recording medium of computer), the packing density has been increased year by year. As means to attain a higher packing density, the gap or spacing between the hard disk and a magnetic head has been reduced. In other words, reduction of the spacing of the raised head has been attempted.

A magnetic head mounted on a hard disk drive is generally of a thin film type magnetic head type, and examples of this type are of an inductive type, an MR-inductive complex type wherein MR (magnet resistance) is used as a recording/reproducing element, and a type using GMR (Giant MR).

These thin film type magnetic heads are composed of a composite material comprised of a substrate such as Altic ($Al_2O_3$—TiC), a ceramic protective/insulation film such as alumina ($Al_2O_3$), a metallic film which is a magnetic material such as permalloy (Fe—Ni) and Sendust (Fe—Al—Si) and the like.

For example, a thin film type magnetic head 12 shown in FIGS. 1 and 2 comprises an Altic substrate 1, an alumina insulation film 2, a bottom shield film 3 (Sendust: FeAlSi, permalloy: Fe—Ni or the like), an alumina film 4, an MR element 5, an alumina film 6, a head shield film 7 (permalloy or the like), an alumina film 8, a write pole tip 9 (permalloy or the like), an alumina protective film 10, and a coil conductor 11.

When conventional free abrasive slurry is used for grinding of ABS (Air Bearing Surface) of a thin film type magnetic head, in most cases, stepped or rough surface results due to selective grinding or abrasion of a metallic film made of soft materials such as permalloy and Sendust, due to difference in hardness between the materials. As a result, there is a problem in that the metallic film (such as magnetic pole portion) is recessed from ABS composed of ceramics, which is called PTR (Pole Tip Recession), increasing the magnetic spacing to a recording medium (as shown in FIG. 2), thereby leading to substantial increase in raised or floating distance of the head.

In order to avoid the above-mentioned selective grinding or damage, Japanese Patent Application Kokai Nos. 3-92264 and 9-245333 proposed that finish-grinding using a lap liquid containing no abrasive grains be conducted, after ABS grinding using free abrasive slurry.

Introduction of such finish-grinding has remarkable effect on solving the above-mentioned problems, in other words, by conducting grinding processing using a lap liquid containing no abrasive grains, selective grinding or rough surface caused by ABS grinding using free abrasive slurry can be recovered.

In addition, an invention which provides free abrasive slurry itself with an ability to avoid selective grinding has been made. For example, Japanese Patent Application No. 10-113327 discloses that, polyether having a molecular weight of 300–20,000 and having 1–6 hydroxide functional groups, obtained by addition reaction of propylene oxide, or optionally ethylene oxide, is added as an anti-selective grinding agent to free abrasive slurry, thereby avoiding selective grinding caused during lapping processing of ABS of a thin film type magnetic head as well as improving the quality of the grinding surface.

Japanese Patent Application No. 10-255022 describes the use of a sulfur-containing organic molybdenum compound as an anti-selective grinding agent. The compound is decomposed by frictional heat generated during grinding processing and forms a film without causing any reaction with the metal surface. The film has the layered structure wherein the layers are mainly composed of molybdenum disulfide ($MoS_2$) and bonded to each other by Van der Waals force which is a weak intermolecular force. Friction at the contact area is replaced by interlayer friction in molybdenum disulfide and is lowered. As a result, the difference in the grinding amount between materials of various hardness is reduced and selective grinding of soft materials is effectively avoided.

However, reduction of the spacing of the raised head and lowering of the PTR value has been further demanded, while improving the quality of grinding surface. Therefore, selective grinding of the metallic film should be avoided, and at the same time, step difference (so called "shoulder step difference") formed at the boundary between Altic (a substrate) and alumina (an insulation film) during grinding processing using free abrasive slurry should be lessened. In other words, further lowering of the PTR value and the improving grinding surface quality become difficult using conventional methods.

Problems to be solved by the present invention

The present invention relates to a lapping oil composition which is advantageously used in finish-grinding of a material to provide a high-quality grinding surface. The present invention particularly relates to a lapping oil composition which is advantageously used in finish-grinding in which a composite material composed of a plurality of materials having different hardness from each other is uniformly ground to provide a high-quality grinding surface, without causing difference in the grinding amount between soft materials and rigid materials, i.e. selective grinding, which is generally caused during lapping and polishing processes of the composite material. The present invention further relates to a lapping oil composition which is advantageously used in finish-grinding in which a composite material is uniformly ground to provide high-quality grinding surface, without causing difference in the grinding amount between different materials, i.e. selective grinding, said finish-grinding using a lap liquid containing no abrasive grains which is conducted after the grinding processing of a surface of a thin film magnetic head to be an air bearing surface, using free abrasive slurry.

Accordingly, the object of the present invention is to provide a lapping oil composition and method for finish-grinding method which overcomes the above-mentioned problems.

SUMMARY OF THE INVENTION

The present invention provides a lapping oil composition for finish-grinding comprising a non-aqueous solvent, at least one member of acetylene glycol compounds and optionally at least one member of phosphoric ester compounds.

The present invention specifically provides the above-mentioned lapping oil composition, wherein said acetylene glycol compound is represented by the following formula (I):

$$R^1C(R^2)(O(C_nH_{2n+1}O)_mH)C{\equiv}C{-}C(O(C_nH_{2n+1}O)_mH)(R^3)R^4 \quad (I)$$

where each of $R^1$, $R^2$, $R^3$ and $R^4$ independently represents an alkyl or alkylaryl group, n=2–4 and m=0–6;

and the above-mentioned lapping oil composition, wherein said phosphoric ester compound is represented by the following formula (II):

$$[R{-}O{-}(C_nH_{2n+1}O)_m]_x(OM)_{3-x}P{=}O \quad (II)$$

where R represents a $C_8$–$C_{18}$ alkyl, alkenyl, alkynyl, aryl or alkylaryl group, n=2–4, m=0–4, x=1–2 and M represents H, Na, K, Ba, an amine, such as $NH_4$, or an alkanolamine, such as $NH(C_2H_4OH)_3$; and the above-mentioned lapping oil composition, which is advantageously used in finish-grinding using a lap liquid containing no abrasive grains which is conducted after the grinding processing of a thin film magnetic head using free abrasive slurry.

Due to the combination of the carbon-carbon triple bond which locates at the center of acetylene glycol compound to be used in the present invention and a hydroxyl or alkoxyl group adjacent to the carbon, pi electron density is remarkably enhanced, and the center of acetylene glycol molecule shows strong polarity.

Therefore, during finish processing, pi electrons of the triple bond and terminal hydroxyl groups (polar groups) of the acetylene glycol compound are oriented to the metallic film of the magnetic head, and selectively adsorbed to the film, thereby forming a protective film, which prevents the metallic film surface from scratching.

According to classification based on acid-base property, metals such as permalloy is classified as soft acid. Since the phenomenon of adsorption is one type of acid-base interaction, it is known that the similar type of acid and base tend to react with each other.

Based on this principle, soft base has high adsorption ability to metal (soft acid), and this mechanism is believed to be the reason for the selective adsorption of the acetylene glycol compound having pi electron to the metallic surface.

On the other hand, newly formed surface obtained by grinding of ceramics, such as Altic and alumina, is uneven and known to have points having different degree of activities from each other (see Masayuki Mori: Tribologist 36-2 (1991) 130–134).

It is believed that phosphoric ester compound has a function of reducing the step between the Altic and alumina owing to the fact that phosphoric ester compound is strongly adsorbed by active points on the newly formed surface of the ceramics, rather than by newly formed surface of the metals, due to its strong acidity, and forms a film. In other words, since ionic bond is predominant between the atoms on the surface of the ceramics such as metal oxide and the crystalline surface is covered with polarized oxygen atoms having larger diameter than that of cations such as metal ions, it is expected that the acidic phosphoric ester compound, which is ionic, is easily adsorbed by the surface of the ceramics.

In the case of the lapping oil of the present invention which contains an acetylene glycol compound, more preferably an acetylene glycol compound and a phosphoric ester compound, it is expected that selective grinding of metallic film be lowered, because the acetylene glycol molecule is selectively adsorbed to the surface of metallic film composed of permalloy or the like, due to the coordination effect by the pi electron of the triple bond and the effect of the terminal hydroxyl groups (polar groups) present in the acetylene glycol molecule. On the other hand, the phosphoric ester compound is electrostatically adsorbed to the ceramic surface due to its strong acidity. Namely, the acetylene glycol compound is selectively adsorbed to the metallic film composed of permalloy or the like, and the phosphoric ester compound to the ceramic surface composed of Altic, alumina or the like, thereby avoiding selective grinding between altic/alumina/metallic film, having different hardness from each other, resulting in excellent ability to attain low PTR value and high grinding surface quality.

BRIEF DESCRIPTION OF THE DRAWINGS

FIG. 1(*b*) shows a structure of a thin film type magnetic head cut out from the wafer.

PREFERRED MODES FOR CARRYING OUT THE INVENTION

Figure 1:
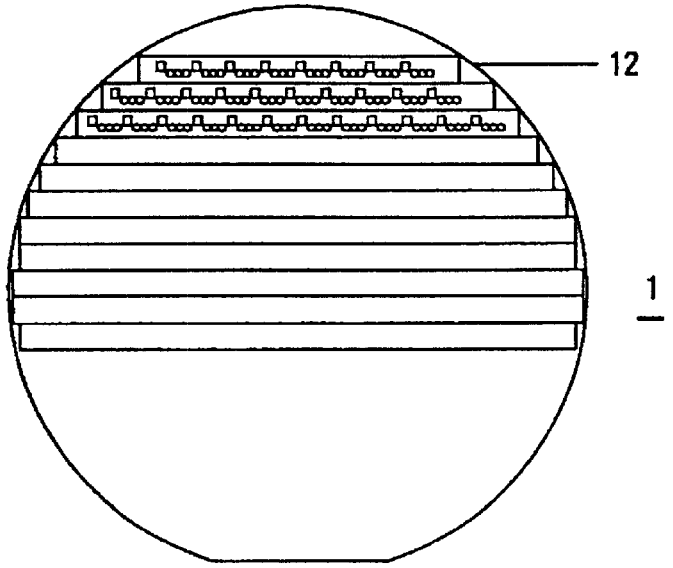
FIG. 1(*a*) shows a wafer to be cut out.
Figure 1:
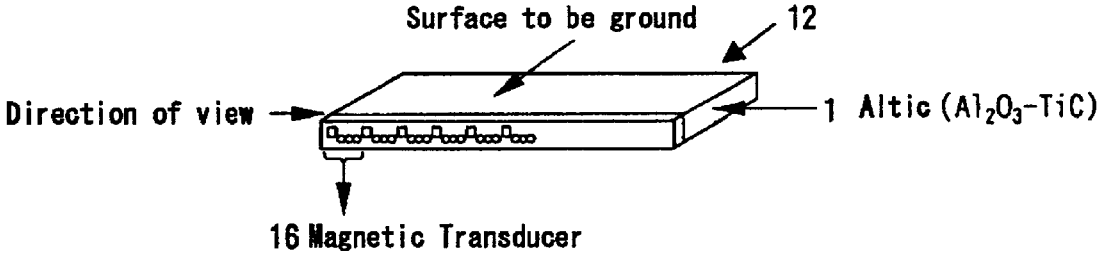

The present invention provides a lapping oil composition comprising (1) at least one member of acetylene glycol compounds as a PTR and surface quality improver, or (2) at least one member of acetylene glycol compounds and at least one member of phosphoric ester compounds and (3) non-aqueous solvent. The present invention provides a lapping oil composition which is advantageously used in oil lap process which is conducted after the grinding processing of ABS of a thin film magnetic head using free abrasive slurry, which requires low PTR value. The present inventors made intensive and extensive studies with the view toward solving the problems of selective grinding between Altic/alumina/metallic film caused during the ABS grinding processing, and attaining low PTR value. As a result, they found that the use of a lapping oil composition containing at least one member of acetylene glycol compounds and optionally at least one member of phosphoric ester compounds as a PTR and surface quality improver avoided selective grinding caused during the grinding processing and attained low PTR value.

The materials to be used in the present invention will be described in detail below.

The acetylene glycol compound (1) to be used in the present invention is represented by the following formula (I):

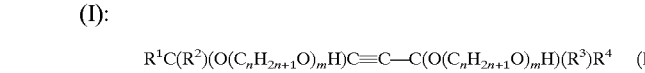

$$R^1C(R^2)(O(C_nH_{2n+1}O)_mH)C{\equiv}C{-}C(O(C_nH_{2n+1}O)_mH)(R^3)R^4 \quad (I)$$

where each of $R^1$, $R^2$, $R^3$ and $R^4$ independently represents an alkyl or alkylaryl group, n=2–4 and m=0–6. Examples include 2,5-dimethyl-3-hexyne-2,5-diol, 2,5-dimethyl-3-hexyne-2,5-diol-bispolyoxyethylene ether, 3,6-dimethyl-4-octyne-3,6-diol, 3,6-dimethyl-4-octyne- 3,6-diol-bispolyoxyethylene ether, 4,7-dimethyl-5-decyne-4,7-diol, 4,7-dimethyl-5-decyne-4,7-diol-bispolyoxyethylene ether, 2,3,6,7-tetramethyl-4-octyne-3,6-diol, 2,3,6,7-tetramethyl-4-octyne-3,6-diol-bispolyoxyethylene ether, 5,8-dimethyl-6-dodecyne-5,8-diol, 5,8-dimethyl-6-dodecyne-5,8-diol-bispolyoxyethylene ether, 2,4,7,9-tetramethyl-5-decyne-4,7-diol, 2,4,7,9-tetramethyl-5-decyne-4,7-diol-bispolyoxyethylene ether, 2,2,3,6,7,7-hexamethyl-4-octyne-3,7-diol, 2,2,3,6,7,7-hexamethyl-4-octyne-3,7-diol, 7-diol-bispolyoxyethylene ether, 6,9-dimethyl-7-tetradecyne-6.9-diol, 6,9-dimethyl-7-tetradecyne-6,9-diol-bispolyoxyethylene ether, 7,10-dimethyl-8-hexadecyne-7,10-diol, 7,10-dimethyl-8-hexadecyne-7,10-diol-bispolyoxyethylene ether, 8,11-dimethyl-9-octadecyne-8,11-diol and 8, 11-dimethyl-9-octadecyne-8,11-diol-bispolyoxyethylene ether, however, there is no limitation with respect to the acetylene glycol compound to be used in the present invention.

The acidic phosphoric ester compound (2) to be used in the present invention is represented by the following formula (II):

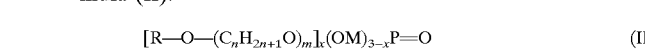

$$[R{-}O{-}(C_nH_{2n+1}O)_m]_x(OM)_{3-x}P{=}O \quad (II)$$

where R represents a $C_8C_{18}$ alkyl, alkenyl, alkynyl, aryl or alkylaryl group, n=2–4, m=0–4, x=1–2 and M represents H, Na, K, Ba, an amine such as $NH_4$, or an alkanolamine such as $NH(C_2H_4OH)_3$. Examples include octyl phosphate, polyoxyethylene octyl ether phosphate, dioctyl phosphate, bis(polyoxyethylene octyl ether)phosphate, 2-ethylhexyl phosphate, polyoxyethylene 2-ethylhexyl ether phosphate, di2-ethylhexyl phosphate, bis(polyoxyethylene 2-ethylhexyl ether)phosphate, nonyl phosphate, polyoxyethylene nonyl ether phosphate, dinonyl phosphate, bis(polyoxyethylene nonyl ether)p hosp hate, decyl phosphate, polyoxyethylene decyl ether phosphate, didecyl phosphate, bis(polyoxyethylene decyl ether)phosphate, lauryl phosphate, polyoxyethylene lauryl ether phosphate, dilauryl phosphate, bis(polyoxyethylene lauryl ether)phosphate, tridecyl phosphate, polyoxyethylene tridecyl ether phosphate, ditridecyl phosphate, bis(polyoxyethylene tridecyl ether) phosphate , cetyl phosphate, polyoxyethylene cetyl ether phosphate, dicetyl phosphate, bis(polyoxyethylene cetyl ether)phosphate, stearyl phosphate, polyoxyethylene stearyl ether phosphate, distearyl phosphate, bis(polyoxyethylene stearyl ether)phosphate, oleyl phosphate, polyoxyethylene oleyl ether phosphate, dioleyl phosphate, bis(polyoxyethylene oleyl ether)phosphate, nonylphenyl phosphate, polyoxyethylene nonylphenyl ether phosphate, di(nonylphenyl)phosphate, bis(polyoxyethylene nonylphenyl ether)phosphate, (dinonyl)phenyl phosphate, polyoxyethylene dinonylphenyl ether phosphate, bis(dinonylphenyl) phosphate and bis(polyoxyethylene dinonylphenyl ether) phosphate, however, there is no limitation with respect to the phosphoric ester compound to be used in the present invention.

The lapping oil composition for finish-grinding, in which the above-mentioned acetylene glycol compound alone or two or more members from both acetylene glycol compound and phosphoric ester compound are used, can avoid selective grinding during grinding processing of a composite material composed of materials having different hardness from each other, and can evenly diminish the step difference between metals and ceramics caused by processing, without lowering grinding efficiency (grinding rate).

Boiling point of the above-mentioned acetylene glycol compound and phosphoric ester compound to be used in the present invention is 80° C. or more, preferably 100° C. or more. Such boiling points are selected since an additive having higher evaporation rate may be evaporated during grinding operation and thus grinding processing may become unstable.

The amount of the acetylene glycol compound or the amount of the acetylene glycol compound and the phosphoric ester compound to be used in the present invention is 0.1–20.0 wt %, preferably 0.5 wt % or more, more preferably 1.0 wt % or more, more preferably 2.0–10.0 wt %, relative to the amount of the lapping oil composition for finish-grinding. When the amount of the additives is small, the formation of adsorbed protective film on the grinding surface is not sufficient, and thus selective grinding may occur. When the amount is excessive, no further effect is observed.

It is desired that the solvent (3) to be used in the present invention is a non-polar solvent, since metallic films, such as a film made of permalloy or Sendust, as components of the thin film type magnetic head are generally susceptible to water and may be rusted. The term "polarity of solvent" has the meaning which is generally used, and means properties based on dipole generated in a molecule which generation depends on types of atoms in the solvent molecules and the types of bonding of the atoms, atomic groups and stereochemistry thereof. The magnitude of the polarity is determined relatively by the polarity of the interacting molecules. The polarity of the solvent is qualitatively represented by δ value [solubility parameter (sp value) of Hildebrand]. The larger the δ value is, the larger the polarity becomes, and vice versa. The δ value is classified into several categories depending on not only the magnitude but also orientation by the polarity and intermolecular interactions (such as hydrogen bonding), and the value determines the dissolution selectivity of the solvent to the compound, i.e., which compound is dissolved easily in the solvent. As the organic solvent which is suitable for the lapping oil for finish-grinding of the present invention, one having the low δ value is desired. If the δ value is not low, the amount of polar components increases and odor is generated from the solvent, or the solvent itself may harm human body and the substance to be ground.

Moreover, in the present invention, a solvent having a low evaporation rate is suitable in order to avoid evaporation of the lapping oil during grinding processing thereby performing stable grinding processing. If the solvent has a high evaporation rate, solvent will be evaporated during the grinding operation and thus the grinding processing may become unstable. From the viewpoint mentioned above, the solvent to be used in the present invention preferably has: a boiling point of 100° C. or more, preferably 120° C. or more; a solubility parameter (sp value) of 10.0 or less, preferably 8.0 or less; and a relative velocity of 5.0 or less, more preferably 2.0 or less. Examples of such solvent include an odorless isoparaffin solvent (Isopar series) and an low-odor naphthene solvent (EXXSOL series), manufactured by Exxon Chemical, Co.; an n-paraffin solvent (Whiterex series), and an industrial aliphatic solvent, such as Pegasol, Pegawhite and Sertrex, manufactured by Mobil Chemical.

The lapping oil composition for finish-grinding of the present invention can be applied to any composite material of various hardness and various surface properties, and examples include an optical fiber connector, a semiconductor element, a VTR head and a floppy head. The present invention is described below in reference to the processing of a thin film type magnetic head.

Figure 3:
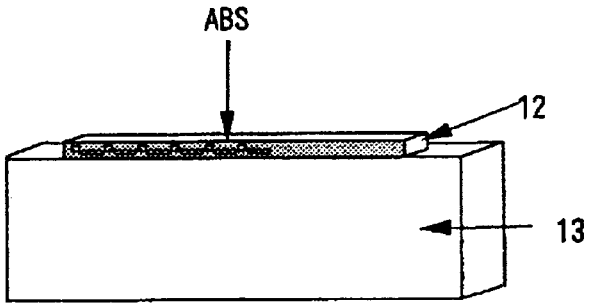
FIG. 3 is a perspective view in which a bar cut out is attached to a processing fixture.
Figure 4:
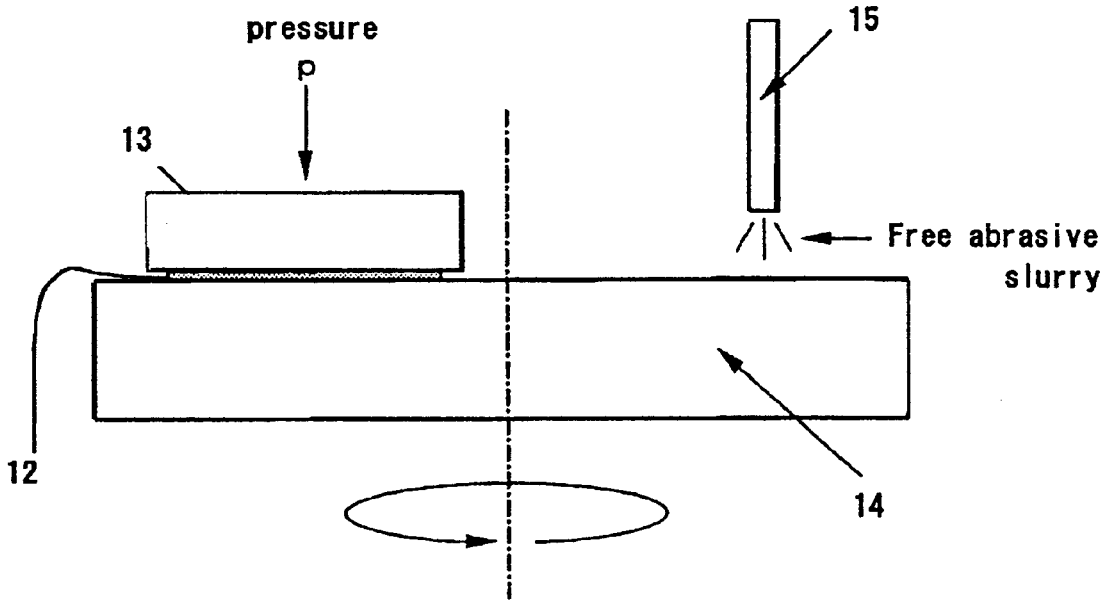
FIG. 4 shows a perspective view of a device which is used in lapping processing using free abrasive slurry and finish-grinding using lapping oil of the present invention.

The raised magnetic head is manufactured in the following steps:

1. Cutting out a bar. A bar 12 is cut out from a wafer 1 in which a number of magnetic conversion elements 16 are arranged in matrix (FIGS. 1(*a*), (*b*)). As shown in FIG. 1, in a bar, a plurality of sliders are arranged in rows.
2. As shown in FIG. 3, the bar 12 is fixed with glue to a processing fixture 13.
3. Lapping processing. As shown in FIG. 4, grinding processing of ABS of the slider is conducted by: placing a substrate to be ground (the bar 12 fixed onto the processing fixture 13) on a surface plate 14 mainly comprising tin; rotating the plate 14; supplying free abrasive slurry and the like from a supplying nozzle 15 under a certain pressure P. After the grinding processing of the ABS, finish girnding using a lap liquid containing no abrasive grains is conducted.
4. Removing the bar 12 from the processing fixture 13.
5. Conducting rail etching processing.
6. Cutting the bar 12 into sliders.

Among these steps, the present invention relates to the grinding processing during the lapping processing of the bar (step 3). The conventional grinding processing of ABS of slider is conducted using free abrasive slurry with controlled throat height and MR height.

Figure 2:
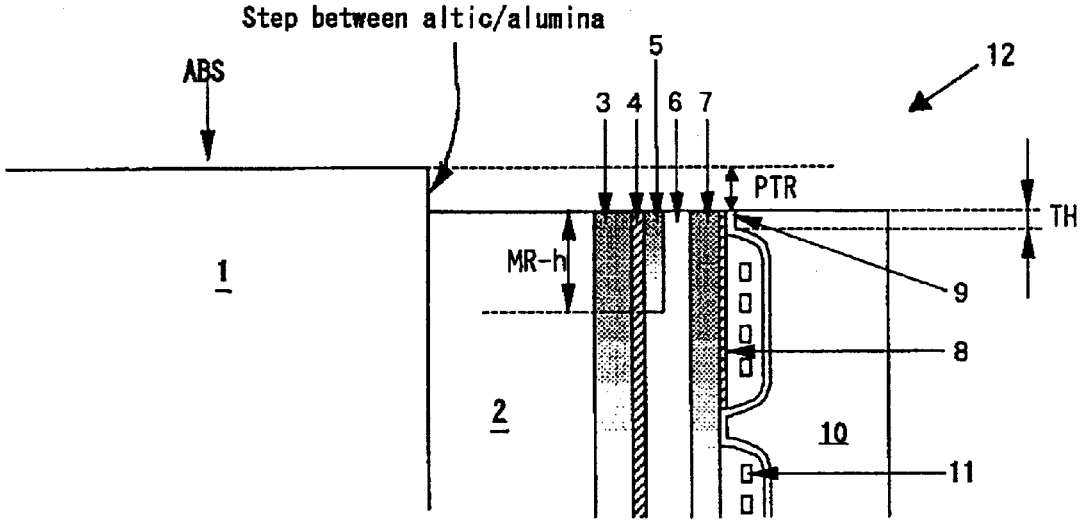
FIG. 2 is a cross-sectional view of a thin film type magnetic head.

The term "throat height (TH)" means one of the factors determining the recording property of a thin film type magnetic head, and is defined as a distance at magnetic pole portion between ABS and the terminus of the insulator which electrically isolates a film coil (indicated as TH in FIG. 2).

A thin film type magnetic head having a magnetic resistance reproducing element is called an MR-inductive composite head, and with respect to this MR-inductive composite head, the height of the magnetic resistance reproducing element is one of the factors which determines recording/reproducing property and this is called MR-height (MR-h). The MR-height is a length of the magnetic resistance reproduction element whose terminus is exposed at ABS, wherein the measurement is made from ABS (indicated as MR-h in FIG. 2).

EXAMPLE 1

Grinding property of the lapping oil composition containing an acetylene glycol compound or an phosphoric ester compound In the present Example, studies were made with respect to the anti-selective grinding effect of the lapping oil containing no abrasive grains on a thin film type magnetic head comprising Altic (2500), Sendust (500) and permalloy (200) during finish-grinding, which was conducted after grinding processing using free abrasive slurry (the parenthesized numbers indicate Vickers hardness). In addition, grinding properties were examined, in the case of grinding processing using free abrasive slurry; and in the case of finish-grinding using a lapping oil containing neither an acetylene glycol compound nor a phosphoric ester compound, which was conducted after the grinding processing using free abrasive slurry. These cases were used as Comparative Samples.

The free abrasive slurry used in the present invention was oily diamond slurry having a diameter of ⅛ μm. The lapping oil contained a solvent and a PTR and surface quality improver. As a non-aqueous solvent, Isopar M which is a non-polar solvent was used. The composition of the lapping oil is shown in Table 1.

TABLE 1

| Material | Weight ratio (wt %) |
|---|---|
| PTR and surface quality improver | 5.0 |
| Solvent (Isopar M) | 95.0 |
| Total | 100.0 |

For grinding test, an automatic precision lapping machine HYPREZ model EJ-3801N (manufactured by Nippon Engis KK) was used. Followings are the finish-grinding conditions conducted with the lapping oil after rough grinding using free abrasive slurry: a tin/lead surface plate was used as a lapping plate; the rotation rate of the surface plate was 5 rpm; the oil grinding liquid was supplied by spraying for 3 seconds at intervals of 30 seconds; processing load was 1,300 g/cm$^2$; and the processing was conducted for 10 minutes.

The grinding properties were evaluated by measuring step difference between Altic and the metallic film of the thin-film type magnetic head after grinding processing, i.e. pole tip recession value (PTR value), using a scanning probe microscope (AFM). When the PTR value of a thin film type magnetic head was 3.0 nm or less, it is evaluated as "good". For the evaluation of scratching and surface roughness, AFM and a differential interference microscope were used.

From the results of the present Example, it was found that when the lapping oil composition containing an acetylene glycol compound or a phosphoric ester compound was used in oil grinding, the PTR value of the ground thin film type magnetic head was lower than that measured in the case of the grinding processing using free abrasive slurry and that measured in the case of the finish-grinding using a lapping oil containing neither an acetylene glycol compound nor a phosphoric ester compound, which was conducted after the grinding processing using free abrasive slurry (Comparative Samples), and the thin film type magnetic head composed of a composite material comprising materials of various hardness was uniformly ground. In addition, it was found that when the lapping oil containing either of polyoxyethylene lauryl ether phosphate, polyoxyethylene oleyl ether phosphate, or polyoxyethylene nonylphenyl ether phosphate was used, the PTR value was notably low.

With respect to the grinding surface, the case of the lapping oil containing an acetylene glycol compound showed better result as compared with the case of the grinding processing using free abrasive slurry and the case of the lapping oil containing neither an acetylene glycol compound nor a phosphoric ester compound. In the case that one kind of additive alone was added to the lapping oil, no further effect was observed when the amount exceeded 5 wt %. The results of the Samples and Comparative Samples are shown in Table 2 below.

TABLE 2

| Sample No | Material | PTR (nm) | Grinding surface |
|---|---|---|---|
| 1 | 3,6-dimethyl-4-octyne-3,6-diol-bispolyoxyethylene ether (4EO) | 2.88 | very good |
| 2 | 2,4,7,9-tetramethyl-5-decyne-4,7-diol-bispolyoxyethylene ether (4EO) | 2.76 | " |
| 3 | lauryl phosphate | 2.57 | small scratches |
| 4 | oleyl phosphate | 2.55 | " |
| 5 | polyoxyethylene lauryl ether phosphate (4EO) | 2.47 | " |
| 6 | polyoxyethylene lauryl ether phosphate (4EO) | 2.44 | " |
| 7 | polyoxyethylene nonylphenyl ether phosphate (4EO) | 2.42 | " |
| Comparative Sample 1 | no lapping oil | 3.50 | small scratches |
| Comparative Sample 2 | additive-free lapping oil | 3.47 | relatively good |

EXAMPLE 2

Effect obtained by combining acetylene glycol compound and phosphorc ester compound In the present Example, studies were made with respect to the anti-selective grinding effect of the lapping oil containing no abrasive grains but both an acetylene glycol compound and a phosphoric ester compound on a thin film type magnetic head comprising Altic (2500), Sendust (500) and permalloy (200) during finish-grinding, which was conducted after grinding processing using free abrasive slurry (the parenthesized numbers indicate Vickers hardness). In addition, grinding properties were examined, in the case of grinding processing using free abrasive slurry; in the case of finish-grinding using a lapping oil containing neither an acetylene glycol compound nor a phosphoric ester compound, which was conducted after the grinding processing using free abrasive slurry; and in the case of finish-grinding using a lapping oil containing other additives. These cases were used as Comparative Samples.

With respect to the composition of the lapping oil used in the present Samples and Comparative Samples, the same amount was used as in Example 1 except that the amount of a PTR and surface quality improver was fixed to 5 wt %, the weight ratio of the acetylene glycol compound and that of the phosphoric ester compound were varied.

The grinding test and the evaluation of grinding properties were made in the same manner as in Example 1.

From the results of the present Example, it was found that when the lapping oil composition containing both an acetylene glycol compound and a phosphoric ester compound was used in oil grinding, the PTR value of the ground thin film type magnetic head is lower than that measured in the case of the grinding processing using free abrasive slurry and that measured in the case of the finish-grinding using a lapping oil containing neither an acetylene glycol compound nor a phosphoric ester compound, which was conducted after the grinding processing using free abrasive slurry (Comparative Samples), and the thin film type magnetic head composed of a composite material comprising materials of various hardness was uniformly ground.

With respect to the grinding surface, the case of the lapping oil containing an acetylene glycol compound and a phosphoric ester compound in the weight ratio of 4.0:1.0–50.0:1.0, preferably 5:1 or more, showed better result as compared with the case of the grinding processing using free abrasive slurry, the case of the lapping oil containing neither an acetylene glycol compound nor a phosphoric ester compound, and the case of the lapping oil containing other additives. The results of the Cases and Comparative Samples are shown in Table 3 below.

TABLE 3

| Sample No | Material | PTR (nm) | Grinding surface |
|---|---|---|---|
| 7 | polyoxyethylene nonylphenyl ether phosphate (4EO) | 2.42 | scratch |
| 8 | 2,4,7,9-tetramethyl-5-decyne-4,7-diol-bispolyoxyethylene ether (4EO) 1.0 wt % polyoxyethylene nonylphenyl ether phosphate 4.0 wt % | 2.42 | small scratches |
| 9 | 2,4,7,9-tetramethyl-5-decyne-4,7-diol-bispolyoxyethylene ether (4EO) 2.5 wt % polyoxyethylene nonylphenyl ether phosphate 2.5 wt % | 2.45 | relatively good |
| 10 | 2,4,7,9-tetramethyl-5-decyne-4,7-diol-bispolyoxyethylene ether (4EO) 4.0 wt % polyoxyethylene nonylphenyl ether phosphate 1.0 wt % | 2.46 | good |
| 11 | 2,4,7,9-tetramethyl-5-decyne-4,7-diol-bispolyoxyethylene ether (4EO) 4.5 wt % polyoxyethylene nonylphenyl ether phosphate 0.5 wt % | 2.50 | very good |
| 2 | 2,4,7,9-tetramethyl-5-decyne-4,7-diol-bispolyoxyethylene ether (4EO) 5.0 wt % | 2.76 | very good |
| 12 | 2,4,7,9-tetramethyl-5-decyne-4,7-diol-bispolyoxyethylene ether (4EO) 4.5 wt % polyoxyethylene oleyl ether phosphate (4EO) 0.25 wt % polyoxyethylene nonylphenyl ether phosphate (4EO) 0.25 wt % | 2.45 | very good |
| 13 | 3,6-dimethyl-4-octyne-3,6-diol-bispolyoxyethylene ether (4EO) 2.25 wt % 2,4,7,9-tetramethyl-5-decyne-4,7-diol-bispolyoxyethylene ether (4EO) 2.25 wt % polyoxyethylene nonylphenyl ether phosphate (4EO) 0.5 wt % | 2.44 | very good |
| Comparative Sample 1 | no lapping oil | 3.50 | small scratches |
| Comparative Sample 2 | additive-free lapping oil | 3.47 | relatively good |
| Comparative Sample 3 | 2,4,7,9-tetramethyl-5-decyne-4,7-diol-bispolyoxyethylene ether (4EO) 4.5 wt % oleyl amine 0.5 wt % | 3.42 | good |
| Comparative Sample 4 | 2,4,7,9-tetramethyl-5-decyne-4,7-diol-bispolyoxyethylene ether (4EO) 4.5 wt % oleic acid 0.5 wt % | 3.62 | good |
| Comparative Sample 5 | oleic acid polyoxyethylene nonylphenyl ether phosphate (4EO) 0.5 wt % | 3.41 | small scratches |

EXAMPLE 3

Effect depending on the amount of an acetylene glycol compound and a phosphoric ester compound In the present Example, studies were made with respect to the relationships between the amount of the lapping oil containing no abrasive grains but both an acetylene glycol compound and a phosphoric ester compound, and effect thereof on a thin film type magnetic head comprising Altic (2500), Sendust (500) and permalloy (200) during finish-grinding, which was conducted after grinding processing using free abrasive slurry (the parenthesized numbers indicate Vickers hardness). The weight ratio of the acetylene glycol compound to the phosphoric ester compound was fixed at 4.5:0.5, and the PTR value and the grinding surface were evaluated when the concentration of the PTR and surface quality improver was changed between 0 and 50 wt %.

The grinding test and the evaluation of grinding property were made in the same manner as in Example 1. In the present Example, the acetylene glycol compound was 2,4,7,9-tetramethyl-5-decyn-4,7-diol-bispolyoxyethlene ether (4EO), and the phosphoric ester compound was polyoxyethylene nonylphenyl ether phosphate (4EO).

Figure 5:
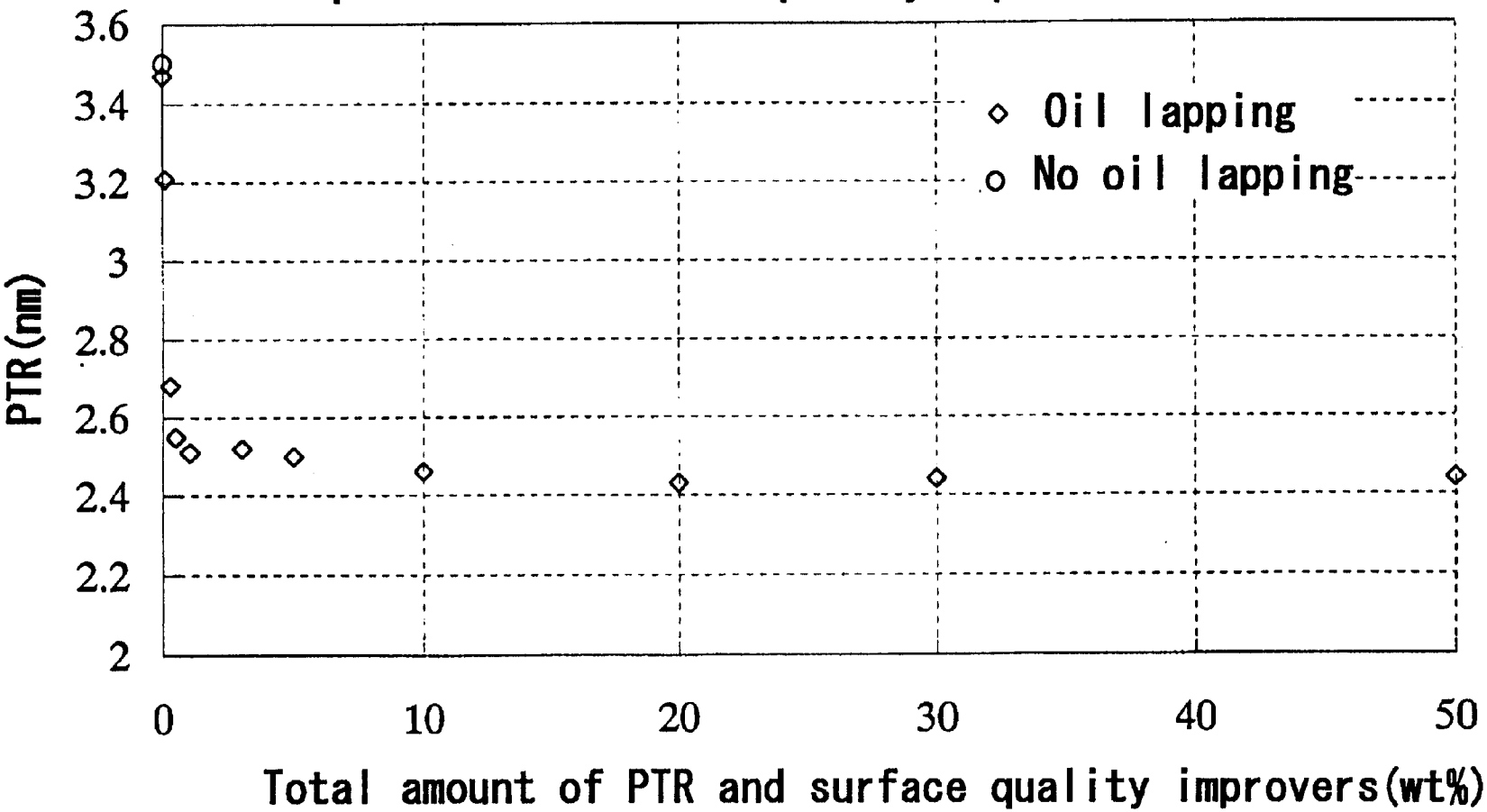
FIG. 5 shows a graph that shows the relationship between PTR (pole tip recession) and the total amount of the PTR and surface quality improver contained in the lapping oil of the present invention.

From the results of the present Example, it was found that when the total amount of the PTR and surface quality imporver was 0.5 wt % or more, the PTR value became small, and the selective grinding of the thin film type magnetic head composed of the composite material was avoided. When the amount is 1.0 wt % or more, more preferably 2.0–10.0 wt %, excellent surface was obtained with no scratches and roughness. When the amount was above 20.0 wt %, no further improvement in effect was observed. As compared with the case of no additives (Comparative Samples), the condition of the grinding surface was excellent. The results of the present Samples and Comparative Samples are shown in Table 4 and FIG. 5.

TABLE 4

| Sample No | Total amount of the PTR and surface quality improver | PTR (nm) | Grinding surface |
|---|---|---|---|
| 14 | 0.1 | 3.21 | good |
| 15 | 0.3 | 2.68 | " |
| 16 | 0.5 | 2.55 | " |
| 17 | 1.0 | 2.51 | very good |
| 18 | 3.0 | 2.52 | " |
| 11 | 5.0 | 2.50 | " |
| 19 | 10.0 | 2.46 | " |
| 20 | 20.0 | 2.43 | good |
| 21 | 30.0 | 2.44 | " |
| 22 | 50.0 | 2.44 | " |
| Comparative Sample 1 | no lapping oil | 3.50 | small scratches |
| Comparative Sample 2 | additive-free lapping oil | 3.47 | relatively good |

As is apparent from Example above, by finish-grinding using a lapping oil containing at least one member of acetylene glycol compounds and optionally at least one member of phosphoric ester compounds, which is conducted after grinding processing using free abrasive slurry, it becomes possible to uniformly grind a composite material composed of materials having different hardness from each other, without causing selective grinding.

The lapping oil for finish-grinding of the present invention can be used regardless of the kind of the free abrasive slurry used in grinding processing conducted before the finish-grinding. In addition, by conducting finish-grinding using the lapping oil of the present invention, improved (i.e. low) PTR value and improved surface quality can be obtained as compared with those obtained by the grinding processing.

What we claim is:

1. A method for finish-grinding a composite material comprising separate materials which differ in hardness from each other, the method comprising finish-grinding said composite material with a lapping oil composition comprising a non-aqueous solvent and at least one acetylene glycol compound.

2. A method according to claim 1, wherein said lapping oil composition further comprises at least one phosphoric ester compound.

3. A method according to claim 1, wherein said at least one acetylene glycol compound is represented by the following formula (I):

$$R^1C(R^2)(O(C_nH_{2n+1}O)_mH)C{\equiv}C{-}C(O(C_nH_{2n+1}O)_mH)(R^3)R^4 \quad (I)$$

where each of $R^1$, $R^2$, $R^3$ and $R^4$ independently represents an alkyl or alkylaryl group, n=2–4 and m=0–6.

4. A method according to claim 2, wherein said at least one acetylene glycol compound is represented by the following formula (I):

$$R^1C(R^2)(O(C_nH_{2n+1}O)_mH)C{\equiv}C{-}C(O(C_nH_{2n+1}O)_mH)(R^3)R^4 \quad (I)$$

where each of $R^1$, $R^2$, $R^3$ and $R^4$ independently represents an alkyl or alkylaryl group, n=2–4 and m=0–6.

5. A method according to claim 2, wherein said at least one phosphoric ester compound is represented by the following formula (II):

$$[R{-}O{-}(C_nH_{2n+1}O)_m]_x(OM)_{3-x}P{=}O \quad (II)$$

where R represents a $C_8$–$C_{18}$ alkyl, alkenyl, alkynyl, aryl or alkylaryl group, n=2–4, m=0–4, x=1–2 and M represents H, Na, K, Ba, an amine or an alkanolamine.

6. A method according to claim 4, wherein said at least one phosphoric ester compound is represented by the following formula (II):

$$[R{-}O{-}(C_nH_{2n+1}O)_m]_x(OM)_{3-x}P{=}O \quad (II)$$

where R represents a $C_8$–$C_{18}$ alkyl, alkenyl, alkynyl, aryl or alkylaryl group, n=2–4, m=0–4, x=1–2 and M represents H, Na, K, Ba, an amine or an alkanolamine.

7. A method according to claim 1 or 3, wherein the amount of said at least one acetylene glycol compound present in the lapping oil composition is in the range of 0.1–20.0 wt %.

8. A method according to any one of claims 2, 4, 5, and 6, wherein the total amount of both said at least one acetylene glycol compound and said at least one phosphoric ester compound present in the lapping oil composition is in the range of 0.1–20.0 wt %.

9. A method according to any one of claims 2, 4, 5, and 6, wherein the weight ratio of said at least one acetylene glycol compound to said at least one phosphoric ester compound is in the range of 4.0:1.0–50.0:1.0.

10. A method according to claim 8, wherein the weight ratio of said at least one acetylene glycol compound to said at least one phosphoric ester compound is in the range of 4.0:1.0–50.0:1.0.

11. A method according to any one of claims 1–6, wherein the composite material which is finish-ground comprises a thin film type magnetic head.

* * * * *